US007621859B2

(12) United States Patent
Kim

(10) Patent No.: US 7,621,859 B2
(45) Date of Patent: Nov. 24, 2009

(54) GOLF SWING EXERCISER

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 0 days.

(21) Appl. No.: 11/564,055

(22) Filed: Nov. 28, 2006

(65) Prior Publication Data

US 2007/0123399 A1 May 31, 2007

Related U.S. Application Data

(60) Provisional application No. 60/740,787, filed on Nov. 30, 2005.

(51) Int. Cl.
*A63B 71/00* (2006.01)

(52) U.S. Cl. ..... 482/139; 482/148; 473/219; 473/231

(58) Field of Classification Search ..... 482/148, 482/44–46, 51, 92–93, 121, 139
See application file for complete search history.

(56) References Cited

U.S. PATENT DOCUMENTS

| | | | | |
|---|---|---|---|---|
| 4,317,567 | A | 3/1982 | Blake | |
| 4,600,190 | A | 7/1986 | Berokoff | |
| 4,614,343 | A | 9/1986 | Radway | |
| 4,671,508 | A | 6/1987 | Tetreault | |
| 4,809,975 | A | 3/1989 | Lee | |
| 4,969,921 | A * | 11/1990 | Silvera | 473/234 |
| 5,133,551 | A * | 7/1992 | Handy et al. | 473/567 |
| 5,577,966 | A | 11/1996 | Duran | |
| 5,769,734 | A | 6/1998 | Qualey, Sr. | |
| 5,868,634 | A | 2/1999 | Choi et al. | |
| 6,461,163 | B1 | 10/2002 | Gallagher et al. | |
| 6,955,610 | B1 | 10/2005 | Czaja et al. | |
| 7,115,042 | B2 | 10/2006 | Gulan et al. | |
| 7,147,580 | B2 * | 12/2006 | Nutter et al. | 473/457 |
| 2005/0153797 | A1 | 7/2005 | Nutter et al. | |
| 2005/0192112 | A1 | 9/2005 | Kim | |

* cited by examiner

*Primary Examiner*—Lori Baker
(74) *Attorney, Agent, or Firm*—Brown & Michaels, PC

(57) ABSTRACT

Components of a golf exerciser are contained within a tube that can be swung in a simulated golf swing independently of a golf club. Within the tube is an extension spring connected to a weight so that centrifugal force developed during swinging the tube can move the weight toward a distal end of the tube. There, a shock absorber is positioned for the weight to impact against whenever sufficient arcuate tube velocity is achieved. The shock absorber includes a deformable elastomer that cushions and stops the distal movement of the weight and also makes a sound indicating that a swing of sufficient velocity has been achieved.

14 Claims, 6 Drawing Sheets

GOLF SWING EXERCISER

REFERENCE TO RELATED APPLICATIONS

This application claims an invention which was disclosed in Provisional Application No. 60/740,787, filed Nov. 30, 2005, entitled "SWING EXERCISER". The benefit under 35 USC §119(e) of the United States provisional application is hereby claimed, and the aforementioned application is hereby incorporated herein by reference.

BACKGROUND

Many sticks, shafts, and bats have been proposed to be swung for exercise purposes. An exerciser willing to do this is usually interested in baseball, golf, or some sport involving swinging a stick, bat, or club. This invention improves on such swing exercisers.

SUMMARY

This invention uses a weight that is elastomerically drawn toward a handle end of a swing exerciser, and the weight has a mass allowing it to move along the length of the swing exerciser. As the exerciser is swung in an arc, the weight moves away from the handle along the length of the exerciser so as to extend or stretch the resilient connection of the weight to the handle end of the exerciser. A high velocity swing of the exerciser in an arc such as described by the swing of a golf club will move the mass to the distal end of the exerciser where it provides increased resistance for the exerciser to work against.

In a preferred embodiment, a spring and a weight are connected within a tube with the spring secured to a handle end anchorage and the weight being free to move toward a distal end of the tube. The mass of the weight is related to the length and force of an extension spring so that the weight can move toward the distal end of the tube as the tube is swung in an arc simulating a golf club swing. At the distal end of the tube is a shock absorber including a deformable elastomer, and when the weight impacts the shock absorber, the elastomer deforms, cushioning the impact and bringing the weight's distal motion to a stop. This produces an audible sound informing the exerciser that the simulated swing has achieved an adequate velocity.

DRAWINGS

FIGS. 1-10 schematically illustrate several variations of preferred embodiments of the inventive swing exerciser.

DESCRIPTION

Figure 1:
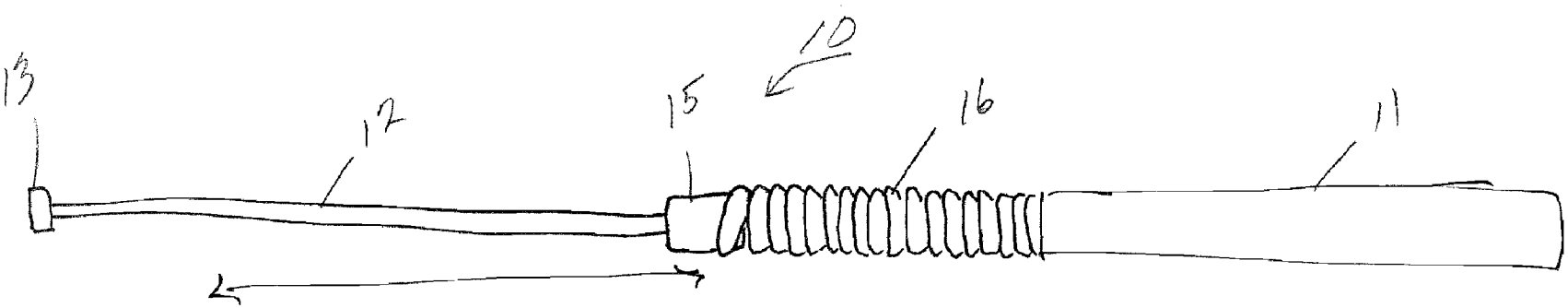
Figure 2:
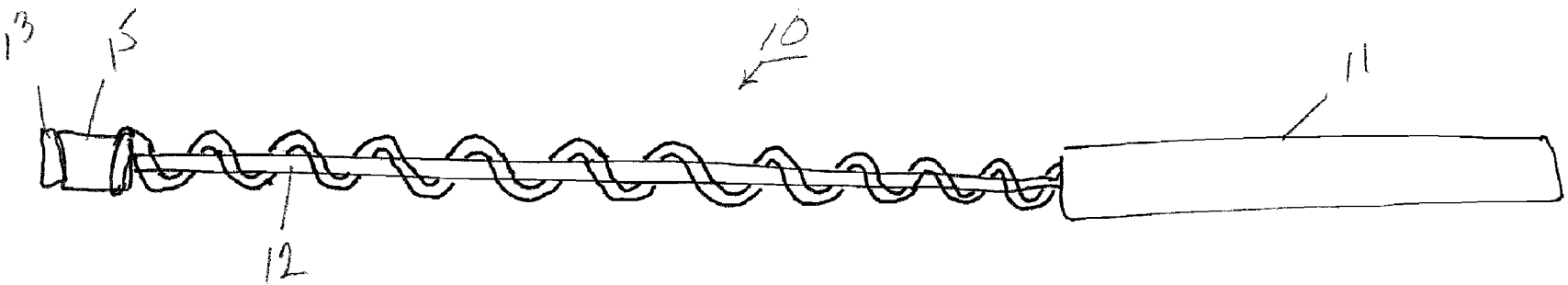

One simple version of the inventive swing exerciser 10 is shown in FIGS. 1 and 2. This includes a hand grip at a handle end 11 of exerciser 10 for swinging the exerciser in an arc. Shaft 12 extends from handle grip 11 to distal end stop 13. A weight 15 has a central bore so that weight 15 can surround and slide along shaft 12, as indicated by the double headed arrow in FIG. 1. A spring or other elastomeric element connects weight 15 to handle 11 and provides resistance to movement of mass 15 along shaft 12 toward distal end stop 13.

Spring 16 is preferably a coiled extension spring, but can also be some other elastomeric element that is able to connect to weight 15 and to handle 11 or shaft 12 and to stretch sufficiently to allow weight 15 to move to end stop 13. Other possible elastomeric elements include bungee cords, pneumatic cylinders, and block and tackle extenders of spring force.

Weight 15 is preferably a metal object that can be shaped in many ways, since its primary function is to provide a mass that resists a swinging motion of exerciser 10. A generally cylindrical shape with a central bore is a simple expedient for the shape of weight 15, but many other shapes are possible, especially if weight 15 performs functions in addition to providing a resistance weight that moves outward from the handle as a swing progresses.

In practice, the force and length of spring 16 and the mass of weight 15 are carefully selected so that for golf swing purposes, for example, it is possible for a high velocity swing to move weight 15 all the way to end stop 13 in the position shown in FIG. 2. In that position, weight 15 represents a club head that must be accelerated for a successful exercise, and such need for acceleration requires a person to develop muscles effective at executing a high velocity swing. The mass of weight 15 should not be large enough to exert a centrifugal pull overwhelming the arms of the person swinging exerciser 10. The total feel of swinging exerciser 10 in an arc should simulate the sports swing being attempted. In other words, for golf swing purposes, the weight and feel of swinging exerciser 10 should approximate that of swinging a golf club, with the exception that movement of weight 15 toward end stop 13 provides an increasing resistance as the swing accelerates. Exerciser 10 is also preferably heavier than a golf club and preferably weighs about twice as much as a golf club.

Spring 16 must not allow weight 15 to move too easily to end stop 13. In other words, the force of spring 16 must be sufficient to require a vigorous and high velocity swing before driving weight 15 all the way to end stop 13. Also, as weight 15 approaches end stop 13, it provides increasing resistance to acceleration of exerciser 10 through a simulated golf swing arc. This forces an exerciser to work against increasing resistance to arcuate acceleration.

For practicing a golf swing, for example, if the mass of weight 15 and the force of spring 16 are properly selected, swinging exerciser 10 can feel very much like swinging a golf club. When swung at a high enough velocity, exerciser 10 can offer a reasonable resistance simulation to the movement of a golf club to help develop muscles involved in such a swing. Making weight 15 too massive or allowing it to reach stop 13 too readily can make exerciser 10 feel too heavy and cumbersome to simulate a golf club. Making spring force 16 too strong can discourage a person from achieving the desired result of moving weight 15 all the way to end stop 13 during a swing.

A high velocity swing requires uncocking the wrists to use the leverage of an outer hand passing over an inner hand to radially accelerate a shaft. Developing high club head velocity that comes from effectively uncocking wrists in a hitting region can drive mass 15 out to end stop 13. As this happens, though, the mass of weight 15 extending farther and farther from handle 11, increasingly resists the development of club head velocity. The sliding weight 15 thus reaches out farther from the handle to provide increasing resistance to a high velocity swing that is valued by a person exercising. Exerciser 10 thus requires development of muscles effective at uncocking the wrists to lever the shaft into a higher radial velocity against the increasing resistance of weight 15.

Experiments with exerciser 10 have shown that spring 16 makes a satisfying and appealing noise as its coils extend out along shaft 12 during an exercising swing. Also, weight 15 can make a click sound when it engages end stop 13, and the combination of the noise of spring 16 and the click sound of weight 15 reaching stop 13 can be a satisfying announcement of a successful swing of device 10.

Figure 3:
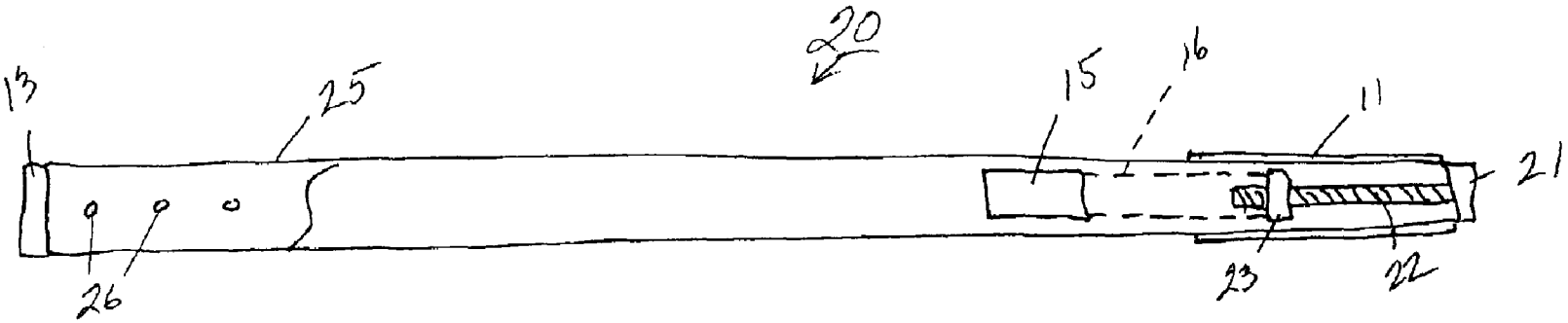
Figure 4:
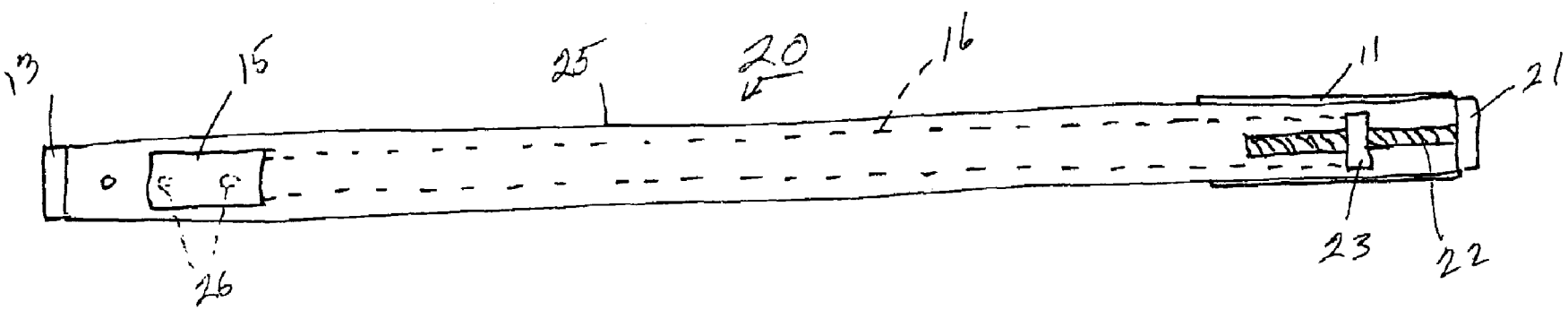

Another version of the inventive exerciser 20 is shown in FIGS. 3 and 4. Instead of a spring and a weight surrounding a rod, a spring 16 and a weight 15 are contained within a tube 25. This keeps all the moving parts enclosed where they are protected, and somewhat simplifies the construction.

A hand grip 11 is formed around a handle end of tube 25 and a knob 21 at the end of handle 11 adjusts a threaded rod 22 that establishes an axial position of a spring adjuster 23. Turning knob 21 can move spring adjuster 23 from the position shown in FIG. 3 to the position shown in FIG. 4, which somewhat extends spring 16 and elongates the extension distance that spring 16 must experience to allow mass 15 to reach end stop 13. This increases the spring force and makes exerciser 20 adjustable in that respect. Making the spring force adjustable is desirable to accommodate persons of different ability in developing a high velocity swing. It can also be used to increase the effort required of a person who has increased an ability to develop a high velocity swing.

A series of holes 26 are formed near the distal end of tube 25. These can make a whistling sound as exerciser 20 is swung. Also, as weight 15 approaches end stop 13, it can block off one or more of the holes 26, as shown in FIG. 4 and change a tone or sound produced. Thus, the sound of swinging exerciser 20 rapidly enough changes as weight 15 approaches end stop 13. This can audibly indicate success to a person swinging exerciser 20.

Figure 5:
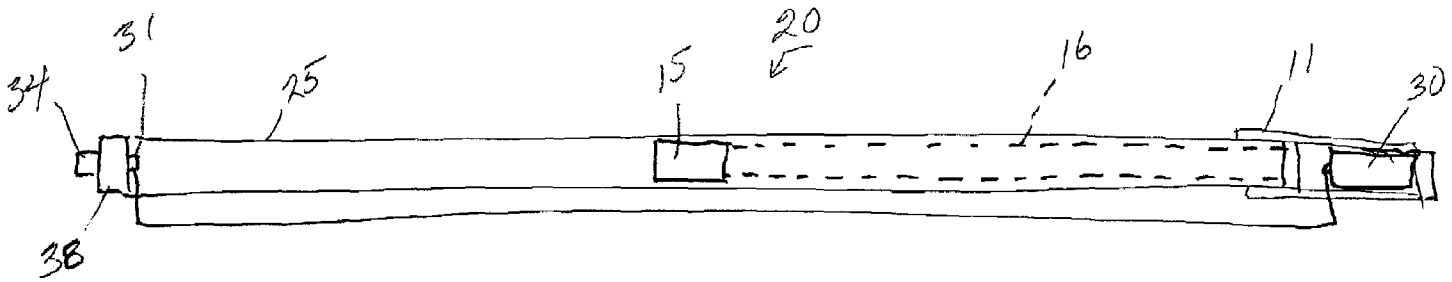
Figure 6:
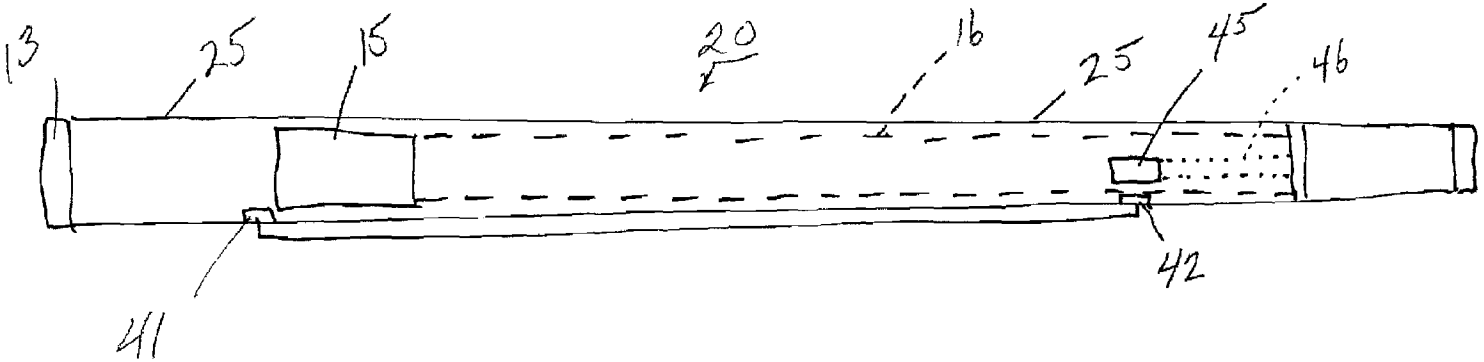

Several variations of tube-type exerciser 20 are schematically shown in FIGS. 5 and 6. Tube 25, mass 15, and spring 16 are common to these.

The embodiment of exerciser 20 illustrated in FIG. 5 includes a battery in handle end 11 and a microswitch 31 arranged in end stop 33. A vigorous swing of exerciser 20 forcing weight 15 into engagement with microswitch 31 closes a circuit allowing the energy of battery 30 to announce a successful swing. This can be done by actuating an audible sounder 38 to make a satisfying sound telling the person swinging exerciser 20 that success has been achieved. Battery 30 can also be deployed to light a light 34 when microswitch 31 closes as a visual indicator of success. Exerciser 20 can be swung proximate to a reflector that directs light from a source such as a light emitting diode 34 to reflect back toward handle 11 so that an exerciser can see the flash of light that occurs. A successful swing can thus produce an audible sound and a visual signal congratulating a person achieving a sufficient velocity of a simulated swing.

The embodiment of FIG. 6 involves a secondary weight 45 and a lighter secondary spring 46 arranged within primary spring 16. A switch 41 that is tripped by the approach of weight 15 near to end stop 13 actuates a companion switch 42 that releases secondary weight 45, which then moves rapidly under centrifugal force to extend its lighter spring 46 and overtake the movement of primary weight 15. This quickly adds the additional mass of weight 45 to the mass of weight 15 and provides an extra resistance for a person to work against in swinging exerciser 20 at a high velocity.

Secondary weight 45 and its spring 46 are preferably contained within primary spring 16 so that once released by switch 42, secondary weight 45 rapidly extends along the path traveled by weight 15 to join weight 15 in approaching end stop 35. The added resistance of secondary weight 45, applied only when the swing of exerciser 20 approaches a high velocity, adds to the effort required of a person to increase the velocity sufficient to drive weight 15 against end stop 13. When the swing of the exerciser approaches its highest velocity, and the extra weight 45 is moved outward to join primary weight 15, this imposes an extra swing resistance on the person wielding the exerciser. This extra resistance is comparable to the resistance met by the head of a golf club in striking a golf ball. A person working against this increased resistance develops muscles necessary to sustain the velocity of a swing during impact with a ball.

The different variations illustrated in FIGS. 1-10 can be combined in various ways. A battery, switches actuating sounds and lights can be added to any of the illustrated embodiments and can be done in many different ways. Mechanical sounders are also possible for making a congratulatory sound when weight 15 is driven against a distal end of an exerciser. Switching such as proposed in FIG. 6 to release secondary weight 45 can be mechanically or electrically powered. The movement of weight 15 along tube 25 can be pneumatically resisted, instead of being spring or elastomerically resisted. An advantage of a spring resistance is the assurance that weight 15 will return toward handle 11 promptly to ready an exerciser for a subsequent swing.

Figure 7:
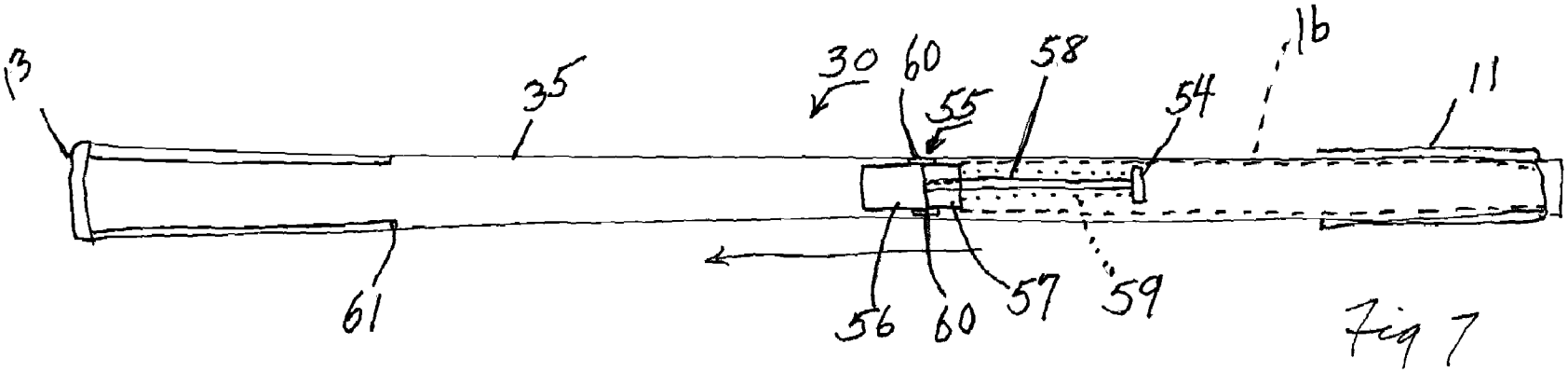
Figure 8:
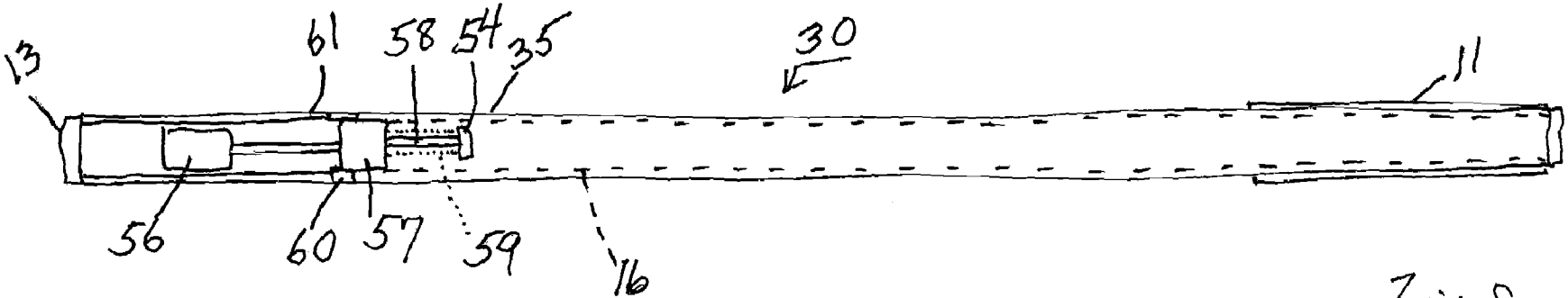

FIGS. 7 and 8 illustrate another preferred embodiment of swing exerciser 30. This includes a weight and spring system arranged within a tube 35 for exercise purposes. A weight 55, as deployed in exerciser 30, involves a distal portion 56 and a proximal portion 57 that are preferably latched or otherwise interconnected for an initial portion of their travel from handle 11 toward end stop 13. A main extension resistant spring connects to proximal weight 57, and distal weight 56 is connected to rod 58 that extends through proximal weight 57. A compression spring 59 arranged between proximal mass 57 and disk 54 on a proximal end of rod 58 urges weights 56 and 57 lightly together. Latches or interconnector 60 holds weights 56 and 57 together as they begin traveling down the length of tube 35 in response to the centrifugal force of an exercising swing.

Near the end of travel for weights 56 and 57 is an abutment 61 or other discontinuity that can have a switching effect. When weights 56 and 57 reach abutment 61, latches 60 are opened or undone so as to remove the connection between weights 56 and 57. This results in holding back proximal weight 57 in the region of abutment 61 and allowing distal weight 56 to proceed rapidly toward end stop 13 under the lighter force of compression spring 59. In effect, the switching that occurs at abutment region 61 suddenly reduces the spring force holding distal weight 56 against the force of a swing. This allows weight 56 to move suddenly toward end stop 13 where it can quickly increase the resistance required to continue the velocity of the swing. This has a desirable effect on the person exercising by suddenly increasing the resistance at the highest velocity region of the swing. For golf purposes, this simulates the effort of driving a golf club head through a stationary ball during the impact region of the swing.

After a swing is completed, compression spring 59 pulls weight 56 back into engagement with weight 57, while mainspring 16 pulls both weights back toward handle 11. This reestablishes the interlock provided by latches 60 between weights 56 and 57.

Latching 60 can be accomplished by a mechanical latching system that releases upon reaching abutment 60 or some other latch releasing mechanism, preferably arranged inside tube 35. Latching 60 may also be possible by use of a permanent magnet joining weights 56 and 57 together.

Arrangements for increasing the mass approaching end stop region 13 to increase swing resistance can be applied in different ways to the various embodiments illustrated in the drawings. An increase in distal end mass can help people develop the muscles necessary to drive the swing vigorously through an impact region. It is known that professional players impart more velocity to a ball per club head velocity than amateurs do. The difference is attributable to the professional being able to maintain the club head velocity as it drives through the previously stationary ball better than amateurs who tend to reduce the swing force on impact. Using an arrangement such as shown in FIGS. 7 and 8 to extend a driven weight rapidly outward toward a distal end region of the exerciser encourages a person to develop the muscles needed to swing the exerciser vigorously through a hitting region to transfer swing velocity into ball velocity.

Figure 9:
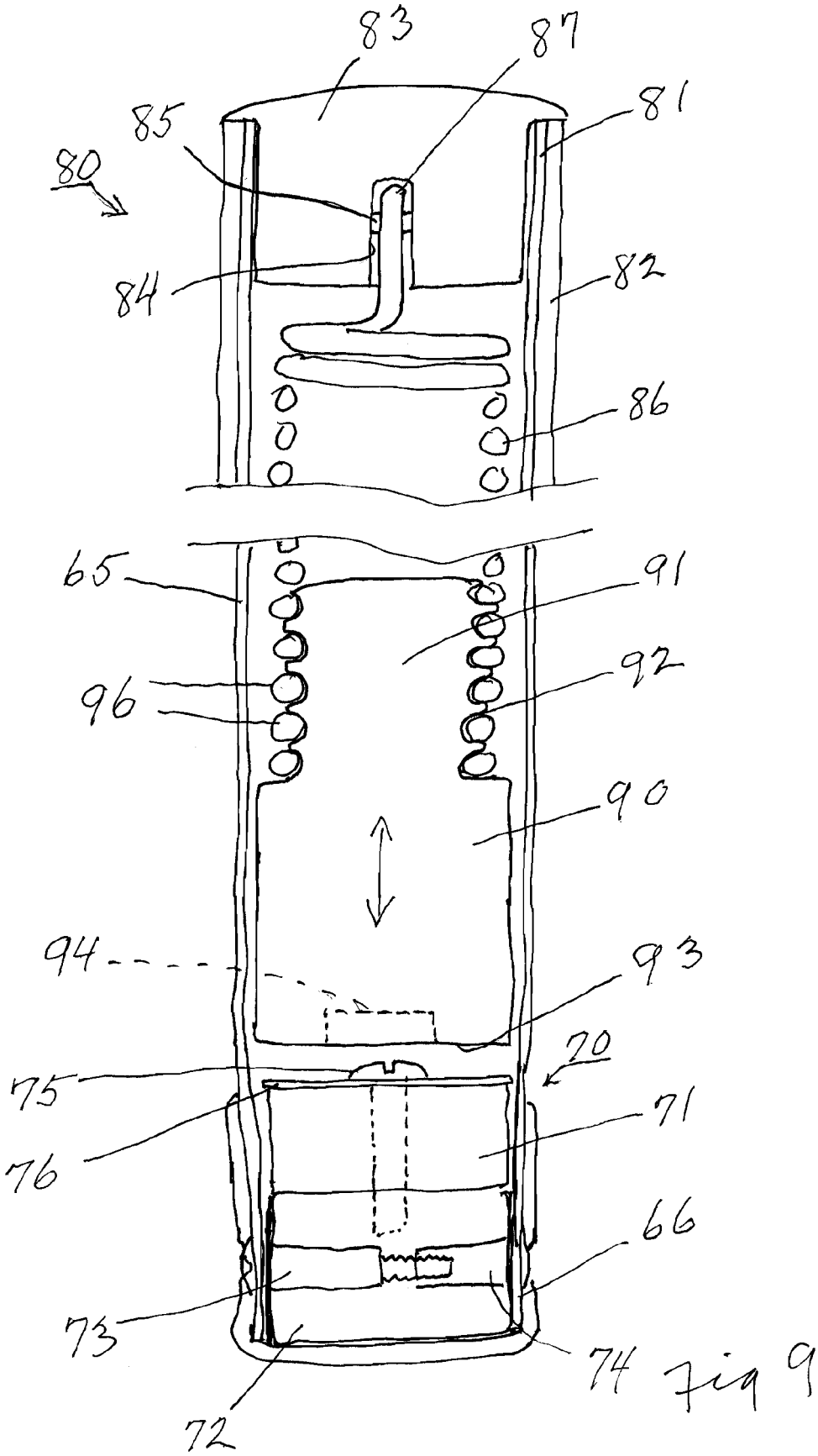

FIG. 9 shows another preferred embodiment of a tube type exerciser 80 having a handle end 81, a hand grip 82, an extension spring 86, and a weight 90, all contained within tube 65. A handle end cap or plug 83 having a slot 84 spanned by a cross pin 85 receiving a hook end 87 of spring 86. This anchors a proximal or handle end of spring 86 within tube 65. Weight 90 is secured to a distal end of spring 86 so that weight 90 and spring 86 can move up and down within tube 65. In the position shown in FIG. 9, weight 90 has moved to a position just short of a distal end of tube 65.

A stem end 91 of weight 90 preferably has a helical groove 92 that can be threaded into distal end convolutions 96 of spring 86. This provides an interference fit reliably securing weight 90 of a distal end of spring 86.

A distal end 66 of tube 65 includes a shock absorber 70 disposed so that weight 90 can impact shock absorber 70. There are many ways that this can be accomplished, and the preferences include that shock absorber 70 close distal end 66 of tube 65 and include a deformable elastomer 71 that can cushion and stop the distal movement of weight 90 as it approaches distal tube end 66. FIG. 9 illustrates one of these several alternatives.

An end plug 72 is preferably securely anchored within distal tube end 66 to support shock absorber 70 against repeated impacts by weight 90. End plug 72 can be formed of different materials, including a metal end cap over tube end 66. As illustrated in FIG. 9, though, end plug 72 is held in place by a shoulder screw 73 threaded into a shoulder nut 74 so that screw 73 and nut 74 extend diametrically cross tube 65 while connecting end plug 72 to a wall of tube 65 in distal end 66.

A washer 76 preferably overlies deformable elastomer 71, and a screw 75 preferably screws washer 76, and deformable element 71 to end plug 72. This keeps everything in place, while washer 76 forms an impact surface that a distal end surface 93 of weight 90 can bang against. A recess 94 in distal end face 93 of weight 90 surrounds a head of screw 75 so that weight 90 does not bang against screw 75.

Figure 10:
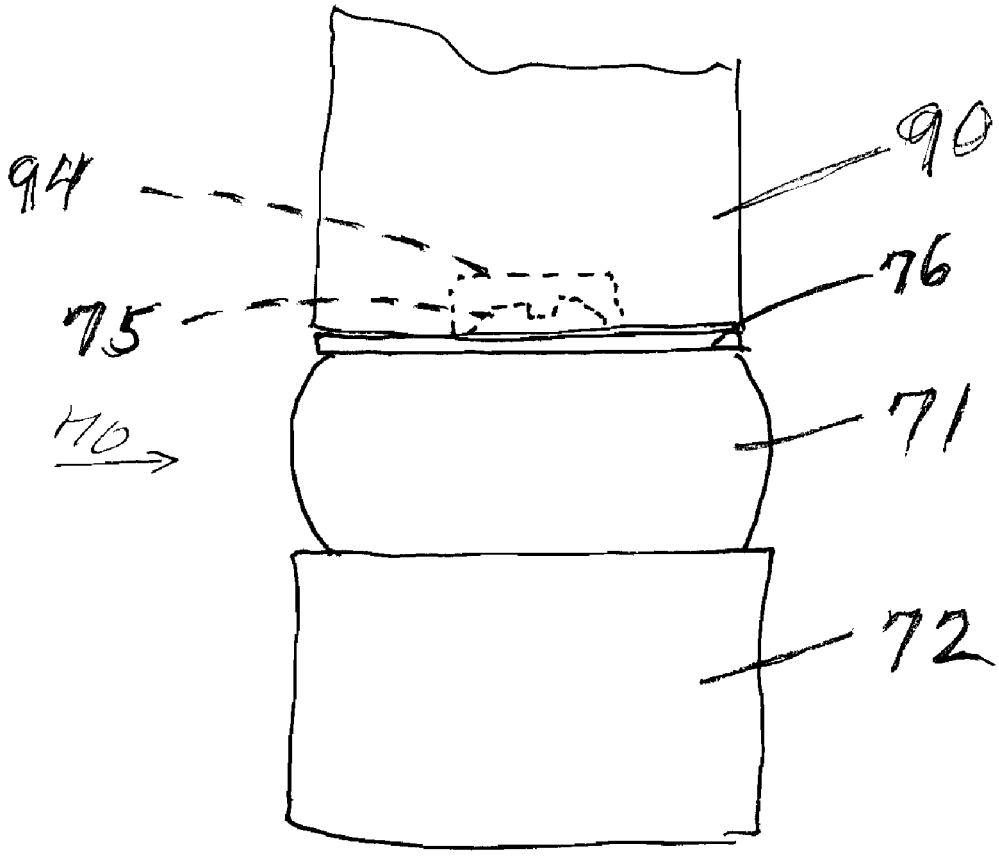

The effect of an impact by weight 90 against washer 76 of shock absorber 70 is illustrated in FIG. 10. Deformable elastomer 71 bulges into a barrel shape as it cushions and absorbs the kinetic energy of weight 90 moving distally against shock absorber 70. This brings the movement of weight 90 to a cushioned stop, and also produces a sound as weight 90 bangs against washer 76.

What is claimed is:

1. A golf swing exerciser using a hollow tube having an anchorage in a handle end for an extendable elastomeric element connected to a weight arranged so that the weight can move toward a distal end of the tube in response to centrifugal force, and the elastomeric element can move the weight toward the handle end of the tube when the weight is not subjected to the centrifugal force, the golf swing exerciser comprising:

the hollow tube being independent of a golf club and not attached to a golf club;

the tube being sized to be swung in an arc simulating a swing of a golf club;

a shock absorber arranged within the tube at a distal end of the tube, the shock absorber including a deformable elastomer;

the weight and the shock absorber being disposed within the tube so that when the tube is swung at a sufficient velocity so that the weight extends the elastomeric element to move the weight to impact the shock absorber at a distal end of travel of the weight; and the weight deforms the elastomer as the shock absorber brings distal movement of the weight to a stop.

2. The exerciser of claim 1 wherein the shock absorber includes a distal end plug, the deformable elastomer, and a screw and washer securing the deformable elastomer to the end plug.

3. The exerciser of claim 2 wherein a distal end of the weight is configured to engage the washer.

4. The exerciser of claim 1 wherein the elastomeric element is an extension spring and the weight has a helically grooved stem that is screwed into distal end convolutions of the extension spring in an interference fit that connects the weight to the spring.

5. The exerciser of claim 1 wherein the shock absorber includes a distal end plug secured to the tube by an assembly that extends through the plug and through diametrically opposite regions of a wall of the tube.

6. A golf swing exerciser including a hollow tube having a distal end stop, an extendable elastic element and a weight attached to the elastic element ; within the tube so that a centrifugal force causes the weight to extend the elastic element and move toward the distal end of the tube, the exerciser comprising:

the tube being independent of a golf club and not attached to a golf club;

a shock absorber supported by the distal end stop;

the weight being arranged to impact the shock absorber; and the shock absorber being arranged to deform elastomerically as it brings the distal movement of the weight to a cushioned stop.

7. The exerciser of claim 6 wherein the shock absorber includes a distal end plug, the deformable elastomer, and a screw and washer securing the deformable elastomer to the end plug.

8. The exerciser of claim 6 wherein the elastomeric element is an extension spring and the weight has a helically grooved stem that is screwed into distal end convolutions of the extension spring in an interference fit that connects the weight to the spring.

9. The exerciser of claim 6 wherein a distal end of the weight is configured to engage the washer.

10. A golf swing exerciser comprising:

a hollow tube having a length approximating a length of a golf club shaft;

the tube being independent of a golf club and not attached to a golf club;

the tube having a handle affording a grip for swinging the tube in an arc simulating a golf swing;

a distal end stop anchored in a distal end region of the tube;

the distal end stop including a shock absorber within the tube;

the shock absorber including a deformable elastomer;

an extendable elastomeric element secured to a handle end anchorage within the tube;

a weight secured to a distal end of the elastomeric element, the weight having a mass related to a length of the elastomeric element and a force of the elastomeric element so that when the tube is swung independently of a golf club in an arc simulating a golf club swing, centrifugal force applied to the weight overcomes the force of the elastomeric element and moves the weight toward the distal end of the tube; and a distal end of the weight being configured to impact the shock absorber so that the deformable elastomer cushions and stops movement of the weight toward the distal end of the tube.

11. The exerciser of claim 10 wherein the exerciser has a golf club.

12. The exerciser of claim 10 wherein the elastomeric element is an extension spring and the weight has a helically grooved stem threadably received within distal convolutions of the extension spring for an interference fit retaining the weight on the spring.

13. The exerciser of claim 10 wherein the distal end stop anchorage includes a plug secured to a wall of the tube.

14. The exerciser of claim 13 wherein the distal end plug is secured to the tube by an assembly that extends through the plug and through diametrically opposite regions of a wall of the tube.

* * * * *